US007937899B2

(12) United States Patent
Earls

(10) Patent No.: US 7,937,899 B2
(45) Date of Patent: May 10, 2011

(54) WATER DRAIN

(76) Inventor: Bobby J. Earls, Lady Lake, FL (US)

( * ) Notice: Subject to any disclaimer, the term of this patent is extended or adjusted under 35 U.S.C. 154(b) by 0 days.

(21) Appl. No.: 12/314,048

(22) Filed: Dec. 3, 2008

(65) Prior Publication Data

US 2009/0151274 A1 Jun. 18, 2009

Related U.S. Application Data

(60) Provisional application No. 61/014,501, filed on Dec. 18, 2007.

(51) Int. Cl.
*E02D 19/00* (2006.01)
*E04B 1/66* (2006.01)

(52) U.S. Cl. ..... 52/169.5; 52/302.7

(58) Field of Classification Search ..... 52/169.5, 52/302.7, 97, 302.1, 209, 302.3, 473; 49/373, 49/408; 454/270, 271
See application file for complete search history.

(56) References Cited

U.S. PATENT DOCUMENTS

| | | | | | |
|---|---|---|---|---|---|
| 3,220,079 | A | * | 11/1965 | Aggson | 52/302.3 |
| 4,026,082 | A | * | 5/1977 | Crofoot | 52/302.7 |
| 4,211,447 | A | | 7/1980 | DiVincenzo | |
| 4,924,647 | A | | 5/1990 | Drucker | |
| 5,007,215 | A | | 4/1991 | Minter | |
| 5,167,104 | A | * | 12/1992 | Alvarado | 52/302.7 |
| 5,340,234 | A | | 8/1994 | Rossi et al. | |
| 5,444,947 | A | * | 8/1995 | Miller | 52/100 |
| 5,460,572 | A | * | 10/1995 | Waltz et al. | 454/273 |
| 5,496,213 | A | * | 3/1996 | Miller | 454/271 |
| 5,571,407 | A | | 11/1996 | Kato | |
| 5,836,135 | A | | 11/1998 | Hagan et al. | |
| 5,976,007 | A | * | 11/1999 | Powell et al. | 454/48 |
| 6,012,260 | A | * | 1/2000 | Hendrick et al. | 52/302.1 |
| 6,052,959 | A | * | 4/2000 | LaBrosse | 52/302.6 |
| 6,129,838 | A | * | 10/2000 | Millner | 210/164 |
| 6,141,916 | A | | 11/2000 | Shackelford | |
| 6,165,066 | A | * | 12/2000 | Sharp et al. | 454/273 |
| 6,272,804 | B1 | | 8/2001 | Leis | |
| 6,319,397 | B1 | | 11/2001 | Su et al. | |
| 6,431,980 | B1 | * | 8/2002 | Achen | 454/271 |
| 6,973,757 | B2 | * | 12/2005 | Marks | 52/302.1 |
| 7,128,643 | B2 | * | 10/2006 | Beliveau et al. | 454/276 |
| 7,246,472 | B2 | | 7/2007 | Nielsen | |
| 2006/0143856 | A1 | | 7/2006 | Rosko et al. | |
| 2007/0254585 | A1 | * | 11/2007 | Achen | 454/271 |

FOREIGN PATENT DOCUMENTS

| | | |
|---|---|---|
| DE | 4136292 | 5/1992 |
| EP | 0195190 | 9/1986 |
| JP | 2005097915 | 4/2005 |

* cited by examiner

*Primary Examiner* — Basil Katcheves
*Assistant Examiner* — Andrew J Triggs
(74) *Attorney, Agent, or Firm* — Richard C. Litman

(57) ABSTRACT

The water drain is a hollow body defining a drainage aperture. The hollow body is adapted for installation in a screen base channel in a lanai, verandah, or screened porch. The hollow body is preferably a flat tube made of plastic, and has a mounting flange around the periphery of one end of the tube. A web or divider wall may bifurcate the hollow body from front to back, adding strength to the walls of the tube. A cap fits over the drainage aperture to limit fluid flow therethrough. The water drain may alternatively be made of aluminum or other corrosion-resistant metal.

6 Claims, 3 Drawing Sheets

WATER DRAIN

CROSS-REFERENCE TO RELATED APPLICATION

This application claims the benefit of U.S. Provisional Patent Application Ser. No. 61/014,501, filed Dec. 18, 2007.

BACKGROUND OF THE INVENTION

1. Field of the Invention

The present invention relates generally to drainage mechanisms, and more particularly a water drain for a lanai, a verandah, a screened porch, or the like.

2. Description of the Related Art

Many homes, particularly in southern climates, are provided with a lanai, verandah, screened porch, or the like. In temperate climates, such partially open structures permit residents and guests to enjoy warm outdoor weather while having a roof for shade and a screen for protection from insects. However, since such structures are at least partially exposed to the elements, it is often necessary to clean the floors with a garden hose or the like, and sometimes standing water will collect after a rainfall. In order to protect the floor from water damage, and for the comfort and safety of the residents and guests, a drainage system to prevent standing water from collecting on the floor and to promote quicker drying is desirable, but preferably in a manner that is unobtrusive and does not mar the aesthetics of the structure.

Thus, a water drain solving the aforementioned problems is desired.

SUMMARY OF THE INVENTION

The water drain is a hollow body defining a drainage aperture. The hollow body is adapted for installation in a screen base channel in a lanai, verandah, or screened porch. The hollow body is preferably a flat tube made of plastic, and has a mounting flange around the periphery of one end of the tube. A web or divider wall may bifurcate the hollow body from front to back, adding strength to the walls of the tube. A cap fits over the drainage aperture to limit fluid flow therethrough. The water drain may alternatively be made of aluminum or other corrosion-resistant metal.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
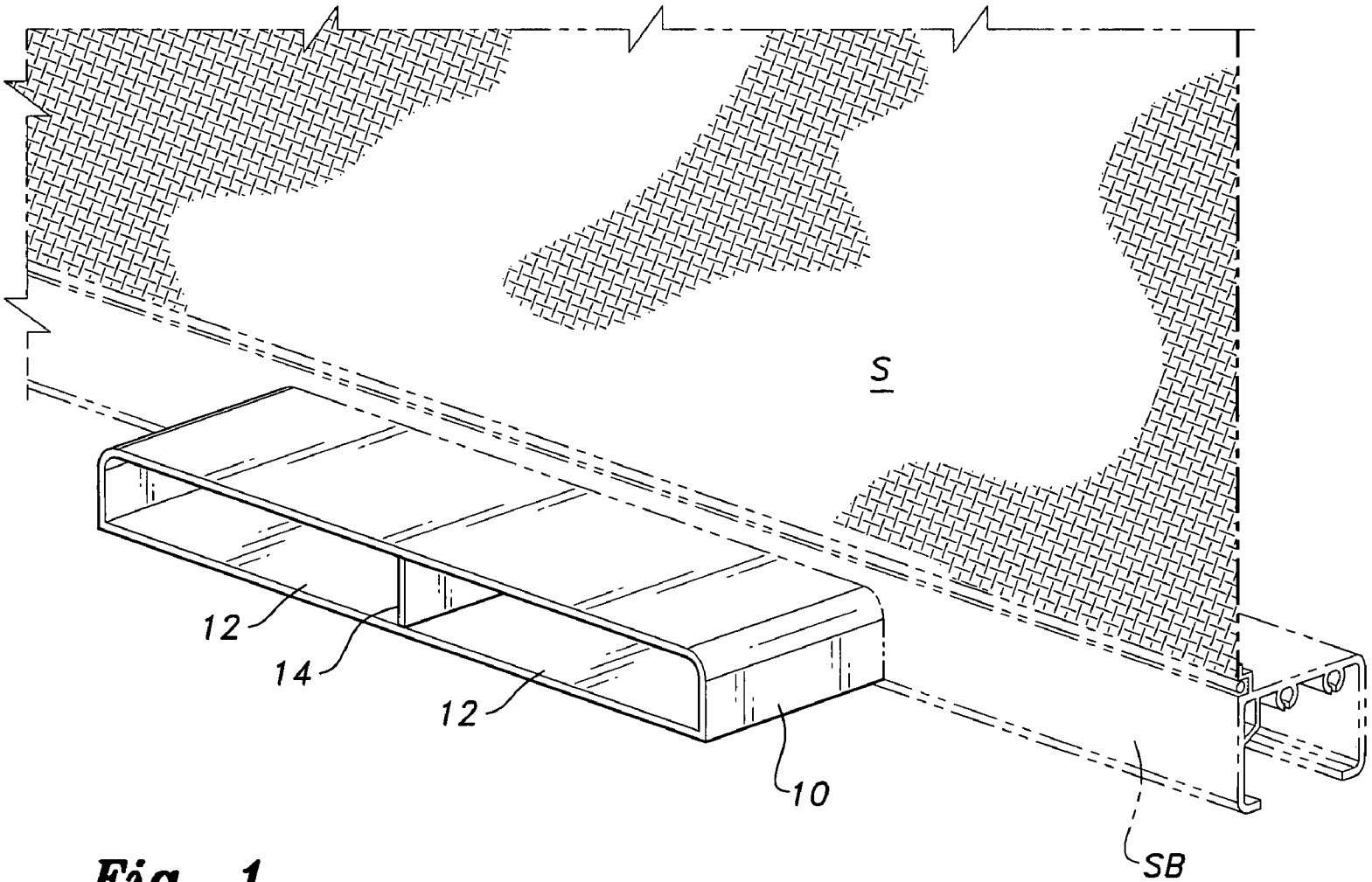
FIG. 1 is an environmental perspective view of a water drain according to the present invention, shown from the outside of the screened area.
Figure 2:
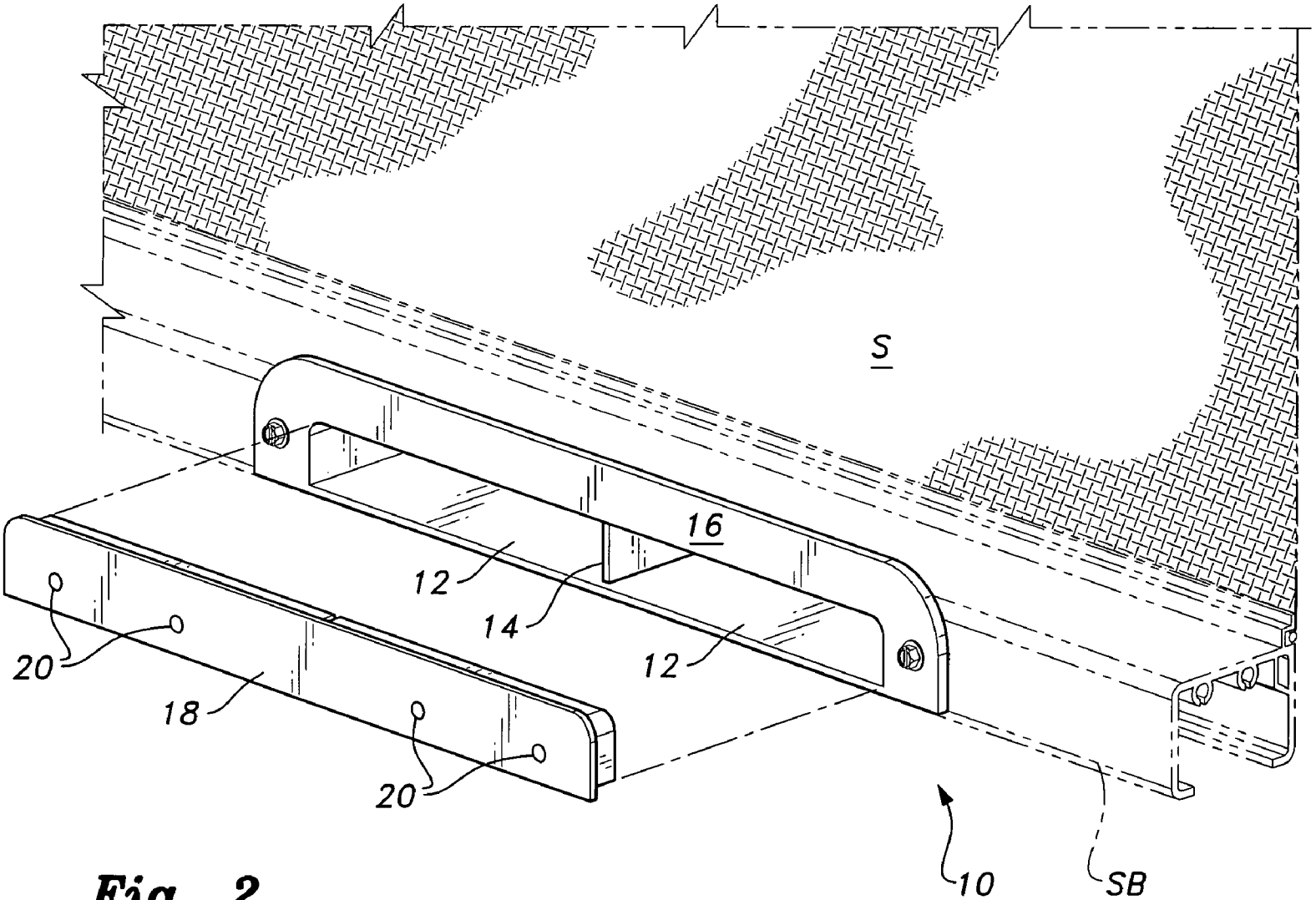
FIG. 2 is an environmental perspective view of the water drain of FIG. 1, shown from the inside of the screened area and with the cap exploded from the drain body.
Figure 3:
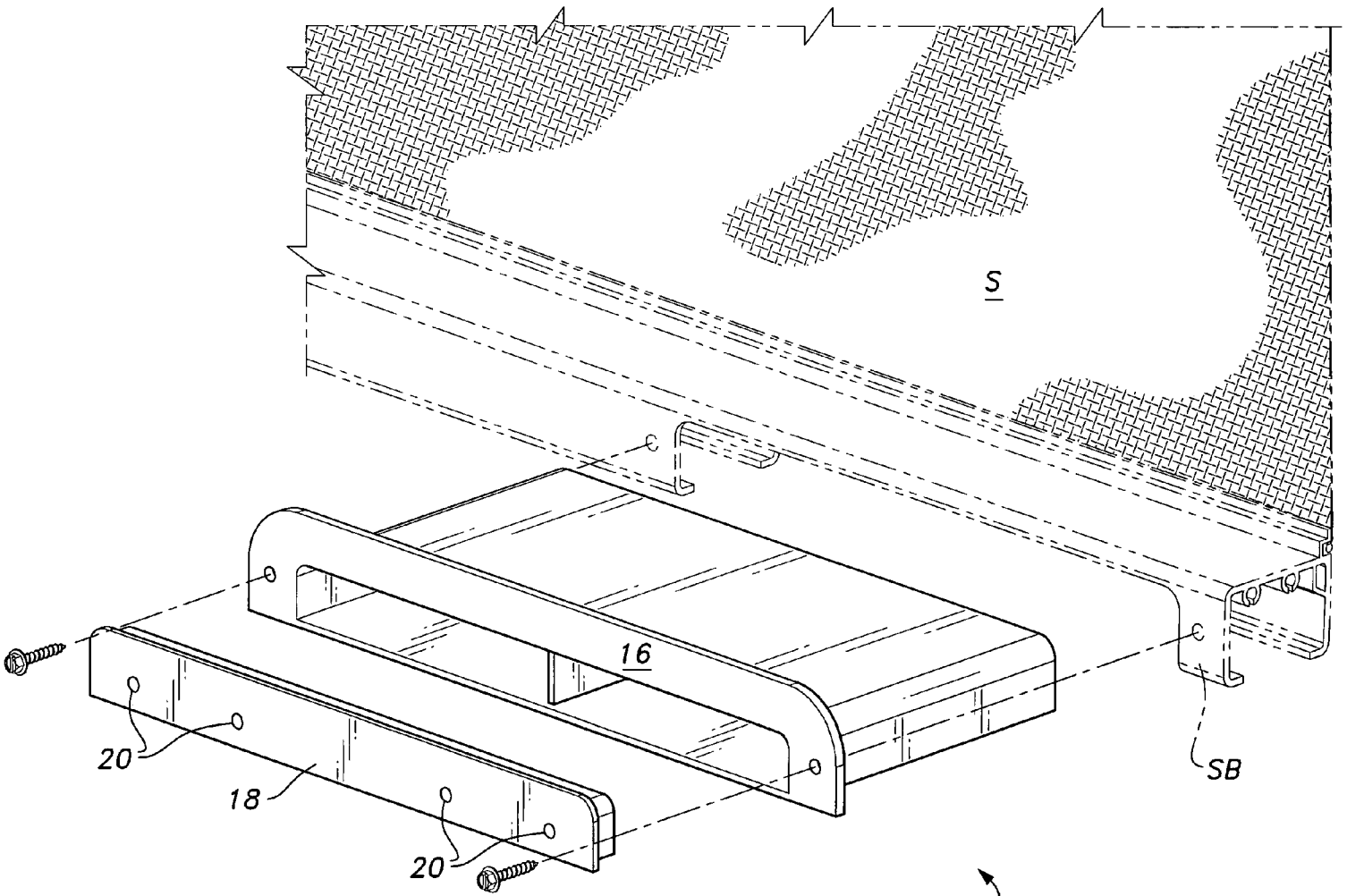
FIG. 3 is an exploded environmental perspective view of the water drain of FIGS. 1 and 2, showing the manner of installing the water drain.

As shown in FIGS. 1 through 3, a common method of mounting a screen for a lanai, verandah, screened porch, or similar structure uses a base channel SB that is typically formed from extruded aluminum. The base channel SB, or a component attached to the base channel SB, defines a spline groove. The screen S is stretched over the spline groove, and a rubber spline is pressed over the screen S into the spline groove to attach the screen S to the base channel SB.

The water drain includes a flat, tubular body 10 that forms a drain passage adapted for installation through the base channel SB. The tubular body 10 is preferably made of plastic. A suitable material is Kydex® (Kydex is a registered trademark of Kleerdex Company, LLC of Mount Laurel, N.J.), which is a thermoplastic alloy of acrylic plastic and polyvinyl chloride (PVC) that can readily be used for vacuum forming and is very durable, but other plastic materials may be used, if desired. The tubular body may also be made from aluminum or other corrosion-resistant metals or metal alloys, if desired. Representative dimensions of the tubular body 10 are approximately six inches in width, ⅝ inches high, and three inches deep, although these dimensions are only exemplary.

The tubular body 10 may be bifurcated by a web 14 for strength. The web 14 may be a continuous partition wall that extends from front to rear of the tubular body 10, or may be segmented, e.g., in the front, rear, and middle of the tube. The tubular body 10 defines at least one drain passage, or two drain passages 12 when a web bifurcates the tubular body 10. A mounting flange 16 extends peripherally from the front opening of the tubular body 10, defining tabs that extend laterally and have screw location dimples or holes for self-tapping screws or other fasteners used to attach the tubular body 10 to the base channel SB. Preferably, the flange 16 extends circumferentially around at least the top and sides of the front opening defined by tubular body 10, and forms a lip that prevents the tubular body from sliding too far into the installation hole or slot formed through the base channel SB.

A flanged cap 18 may be provided to compression fit over the drain passage(s) 12 to limit fluid flow therethrough, for aesthetic purposes, or to prevent debris from entering and clogging the drain passage(s) 12. The cap 18 may also be made from Kydex, or from PVC or other suitable material. Moreover, the cap 18 may include a plurality of weep holes 20 disposed across the cap 18 in alignment with the drain passages 12. The weep holes 20 permit water to slowly drain through the tubular body 10 when the cap 18 is installed. The cap 18 may be removed when cleaning the lanai, or when heavy rainfall or similar inclement weather is expected.

The base channel SB may be custom manufactured with an appropriate slot to accommodate hollow body screen drain 10, or an installer may cutout the slot with an appropriate tools. For example, the installer may utilize a multi-step process to install the screen drain 10 with, e.g., a 30,000 rpm electric RotoZip with cable drive, a one-eighth inch side cutting bit, a drill with a one-eighth inch bit, a screw driver with a one-quarter inch hex head, and latex caulking. In a first step, the installer finds the lowest areas on floor at outer edge next to the screen S. In a second step, each slot is marked on the base channel SB with a six-inch long by ⅝ inch high template. In a third step, a ⅛ inch pilot hole is made inside and outside of the marked areas. In a fourth step a cut is made through the base channel SB at floor level on both sides, using the RotoZip. In a fifth step, the tubular body 10 is pushed through the cut out from the inside until the mounting flange 16 abuts the base channel 16. In a sixth step, the tubular body 10 is secured with two #6 hex head self-tapping screws on the inside, and latex caulking on the outside, if needed. In a seventh step four ⅛ inch weep holes 20 are drilled in the cap 18, which is then installed on the tubular body 10.

The water drain 10 can be used in areas where standing water after a rain is a problem. Moreover, the water drain 10 can be used to drain water after a floor area has been hosed down for cleaning, thereby saving time and energy.

It is to be understood that the present invention is not limited to the embodiment described above, but encompasses any and all embodiments within the scope of the following claims.

I claim:

1. A water drain adapted for installation through a screen base channel in a lanai, verandah, or screened porch, comprising:

a flat, tubular, elongated body having a front end and an open rear end, the tubular body defining at least one drain passage having a front opening having a height, the tubular body being adapted for extending through a screen base channel;

a mounting flange extending around at least a portion of the front opening, the mounting flange including laterally extending tabs adapted for mounting the tubular body to the screen base channel, wherein the tabs have screw location dimples for guiding placement of fasteners therethrough for attaching said tubular body to the screen base channel;

a web extending from the front end to the rear end bifurcating said tubular body, whereby said tubular body defines two separate drain passages; and a cap having a peripheral flange engaging the mounting flange and a peripheral ledge having a height that is greater than the height of the drain passage opening extending therefrom forming a compression fit within the entire front opening of said tubular body, wherein said cap has a plurality of weep holes aligned with the two drain passages and an imperforate remaining cap surface.

2. The water drain according to claim 1, wherein said tubular body is made of a metallic material.

3. The water drain according to claim 1, wherein said tubular body is made of a thermoplastic material.

4. The water drain according to claim 1, wherein said tubular body is made from an alloy of acrylic plastic and polyvinyl chloride.

5. The water drain according to claim 1, wherein the flanged cap is made of a thermoplastic material.

6. The water drain according to claim 1, wherein the flanged cap is made of a metallic material.

* * * * *